US005884801A

United States Patent [19]

Simpson

[11] Patent Number: 5,884,801

[45] Date of Patent: Mar. 23, 1999

[54] METHOD OF CONTROLLING INSECTS IN AND AROUND A TRASH CONTAINER AND IMPROVED TRASH BAG THEREFOR

[75] Inventor: Arthur W. Simpson, Honolulu, Hi.

[73] Assignee: Integrated Pest Management Technologies, Inc., Honolulu, Hi.

[21] Appl. No.: 888,820

[22] Filed: Jul. 7, 1997

Related U.S. Application Data

[63] Continuation of Ser. No. 617,578, Mar. 19, 1996, abandoned.

[51] Int. Cl.[6] ..... B65F 1/06

[52] U.S. Cl. ..... 220/495.08; 220/908.1; 220/908.2; 43/114

[58] Field of Search ..... 220/908, 404, 220/403, 730, 908.1, 495.11, 495.08, 495.06, 908.2; 206/205; 383/93, 95; 43/114, 115

[56] References Cited

U.S. PATENT DOCUMENTS

| | | | |
|---|---|---|---|
| 3,539,360 | 11/1970 | Wood | 220/403 |
| 4,488,331 | 12/1984 | Ward | 43/136 |
| 4,577,434 | 3/1986 | Davis | 43/115 |
| 4,654,998 | 4/1987 | Clay | 43/115 |
| 4,944,393 | 7/1990 | Cappuzzo et al. | 206/205 |
| 5,174,462 | 12/1992 | Hames | 220/908 |
| 5,294,194 | 3/1994 | Lombardo | 312/229 |

FOREIGN PATENT DOCUMENTS

| | | | |
|---|---|---|---|
| 381010 | 10/1964 | Switzerland | 43/115 |

*Primary Examiner*—Stephen Castellano
*Attorney, Agent, or Firm*—Howell & Haferkamp, LC

[57] ABSTRACT

An improved trash bag having a sidewall forming a trash-receiving volume, and having an inside surface, an outside surface, and an opening. There is at least one adhesive patch on the inside surface of the trash bag for trapping insects that enter the bag. The adhesive patches preferably extend substantially around the interior of the bag, and are spaced sufficiently from the opening of the bag that when the bag is inserted into a trash container, at least some of the adhesive patches are inside the container. A removable protective cover can be provided on the adhesive patches for protecting the adhesive before the trash bag is used, but which can be removed to expose the adhesive when the trash bag is used. The patches are preferably made to attract insects, for example being of a contrasting color to the inside surface of the bag, having contrasting insect silhouettes, and/or including chemical attractants.

5 Claims, 1 Drawing Sheet

METHOD OF CONTROLLING INSECTS IN AND AROUND A TRASH CONTAINER AND IMPROVED TRASH BAG THEREFOR

CROSS REFERENCE TO RELATED APPLICATION

This is a continuation of application Ser. No. 08/617,578 filed Mar. 19, 1996 now abandoned.

BACKGROUND AND SUMMARY OF THE INVENTION

This invention relates to controlling insects in and around trash containers, and to an improved trash bag therefor.

Trash containers, and particularly outdoor trash containers, attract flies and other insects. These insects are annoying and can spread disease. Conventional methods of controlling insects, such as with the liberal application of insect repellents or pesticides, are expensive and can have an adverse effect on the environment. Moreover, the insect repellant or insecticide must be periodically reapplied.

The present invention provides a simple, easy, inexpensive, and environmentally sound method of controlling insects, and particularly flies, in and around a trash container. Generally, the method of the present invention comprises the step of lining the trash container with a trash bag having an inside surface, an outside surface, and an opening, and at least one adhesive patch on the inside surface of the trash bag for trapping insects that enter the bag. The adhesive patches are preferably provided with a removable protective cover for protecting the adhesive, which can be removed after the trash bag is placed in the trash container.

The bag of this invention can be a conventional trash bag, comprising a sidewall defining a trash receiving volume, and having an inside surface, an outside surface, and an opening. The bag has at least one adhesive patch on the inside surface for trapping insects that enter the bag. There is preferably a removable protective cover on the adhesive patch for protecting the adhesive before the trash bag is used, but which can be removed to expose the adhesive when the trash bag is used. The adhesive patches are preferably positioned on the bag so that when the bag is installed in a trash container, the adhesive patches are inside the container.

The adhesive patches are preferably made to attract insects, and particularly flies, that enter the bag. For example, the adhesive patches may be a contrasting color to the inside surface of the bag to attract insects that enter the bag. The adhesive patches could also include silhouette decoys of insects, for example silhouettes of flies, in a contrasting color to attract insects that enter the bag. The adhesive patches could also include insect attractants, such as pheromones, to attract insects that enter the bag.

The method of this invention provides a way of controlling insects, and particularly flies, in and around trash containers. The method is safe, inexpensive, and environmentally sound. The trash bags of this invention and used in the method of this invention are of simple, inexpensive construction, and can easily fabricated with existing bag manufacturing equipment.

These and other features and advantages will be in part apparent, and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

The method of this invention provides a way to control insects, and particularly flies, in and around trash containers. Generally, the method comprises lining the trash container with a trash bag having an inside surface, an outside surface, and an opening, and at least one adhesive patch on the inside surface of the trash bag for trapping insects that enter the bag. The adhesive patch is preferably positioned so that when the bag is installed inside the container, the patches are inside the container.

Figure 1:
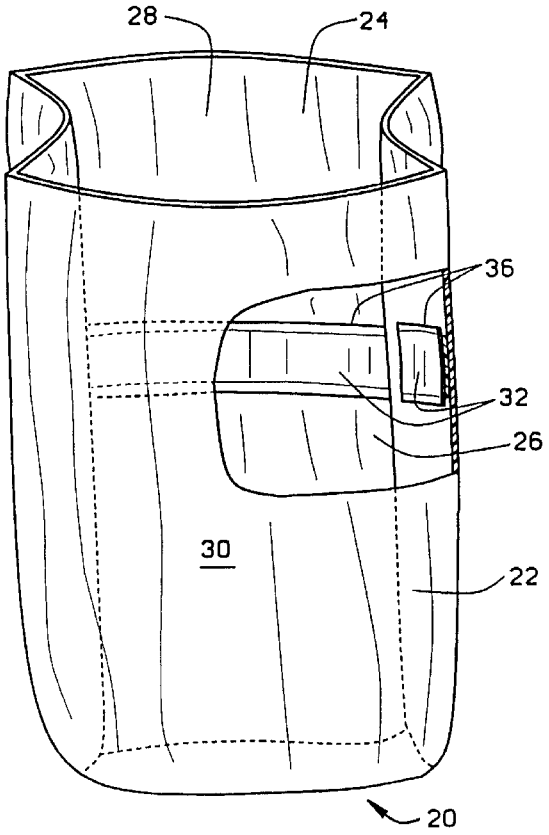
FIG. 1 is a side elevation view of a bag constructed according the principles of this invention, with a portion broken away to reveal the construction of the adhesive patches.
Figure 2:
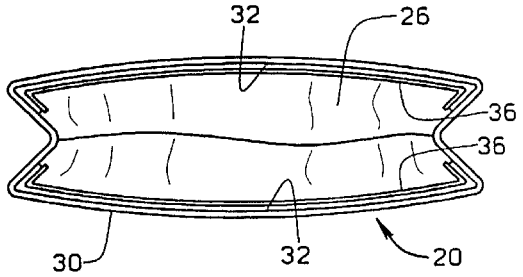
FIG. 2 is a partial cross sectional view of the bag showing an adhesive patch.
Figure 4:
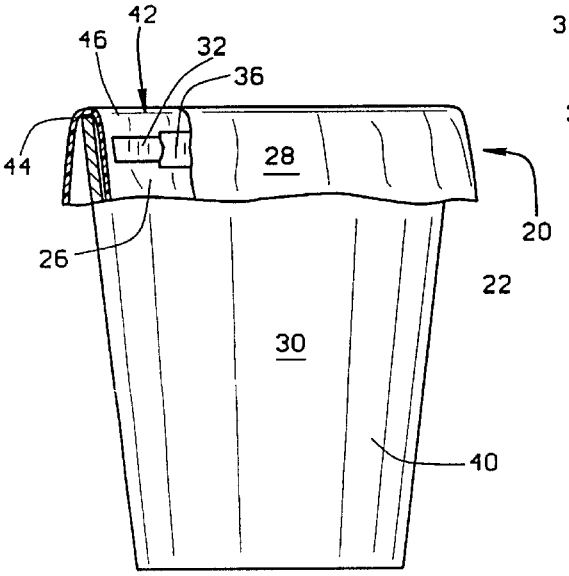
FIG. 4 is a perspective view of a bag constructed according to the principles of this invention, shown as it would be installed in a trash container according to the method of this invention.

The improved trash bag of this invention, which is adapted for use with the method of this invention, is indicated generally as 20 in FIGS. 1 and 4. The bag 20 may be a conventional plastic trash bag, which may include any of the features available on trash bags. The bag 20 comprises a sidewall 22 having an opening 24 therein and defining a trash-receiving volume 26. The sidewall has in inside surface 28 and an outside surface 30.

There is preferably at least one adhesive patch 32 on the inside surface 28 of the trash bag 20. This adhesive patch may be an adhesive applied to the inside surface of the bag. Alternatively, the adhesive patch may be a double sided adhesive film applied to the inside surface of the bag. This patch could also be applied later by the user. In the preferred embodiment there are two elongate patches positioned to extend substantially continuously around the inside of the bag, spaced sufficiently from the opening 24 that when the bag is installed in a conventional trash container, the adhesive patches are inside the container. Of course, some other number and arrangement of patches can be used. It is desirable that the patches be sufficiently large to provide an effective insect trap, yet are not positioned too low in the bag so that they adhere to the trash deposited in the bag, or to high in the bag so that they are not located inside the trash container.

Figure 3:
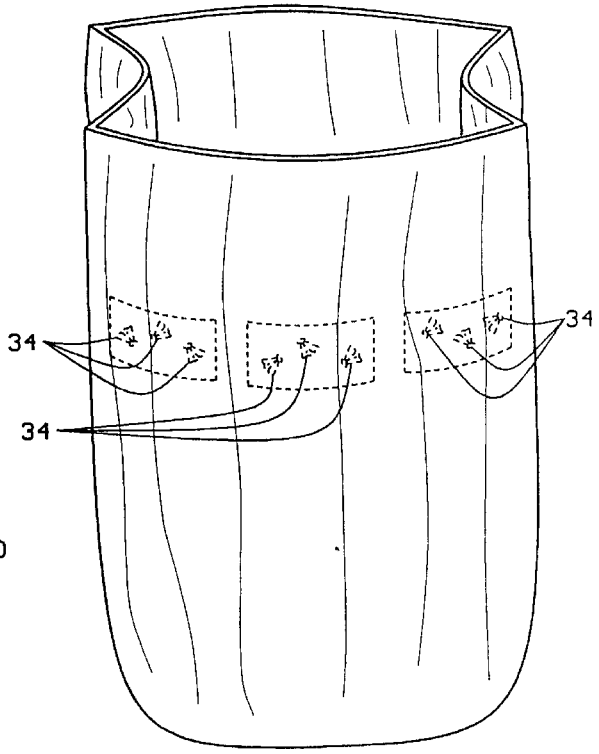
FIG. 3 is a plan view of an alternative construction of the adhesive patch.

The patches can be made to attract insects that enter the bag, for example the patches can be made of a contrasting color to the inside surface of the trash container. For example, the portions of the bag where the patches are applied could be made of a contrasting color, or a dye could be included in the adhesive. Alternatively or in addition, silhouettes of insects in a contrasting color, such as fly silhouettes 34, can be formed on the adhesive patches act like decoys. (See FIG. 3) For example these silhouettes can be printed on the bag or on the adhesive strip, or these silhouettes can be applied onto the adhesive strip. Finally, chemical attractants, such a pheromones, could be included in the patches. For example, the chemical attractant could be mixed with the adhesive before it is applied.

A removable protective cover 34 is preferably provided on each adhesive patch 32 for protecting the adhesive patches before the trash bag is used. The cover 34 may be, for example, a paper strip treated with a silicone release agent. The covers 36 prevent the patches from sticking or adhering to other portions of the bag, and help maintain the stickiness of the patches. These covers 36 can be removed after the trash bag is installed in a trash container to expose the adhesive patches 32.

OPERATION

In operation a trash bag 20 according to the principles of the present invention is installed in a conventional trash container 40. The trash container 40 comprises a sidewall having an opening 42 surrounded by a rim 44 that forms a trash receiving volume 46. As is well known, the trash bag is placed in the trash-receiving volume 46 and the edge margins adjacent the opening of the bag are pulled over the rim of the trash container, as shown in FIG. 4. Once the trash bag 20 is installed inside the trash container 40, the covers 36 are removed from the adhesive patches 32 to expose the adhesive. Alternatively, once the bag is installed in a trash container, the user can apply adhesive patches to the inside of the bag in the appropriate positions. The adhesive patches trap insects that enter the trash bag and lite upon them.

The patches are preferably formed to be attractive to insects that enter the bag, to distract the insects from the trash that originally attracted them into the bag. Thus the bag 20 helps control insects, and particulary flies, in and around the trash receptacle.

What is claimed is:

1. A trash bag of the type including a sidewall forming a trash-receiving volume, and having an inside surface, an outside surface, and an opening, the improvement comprising at least one adhesive patch on the inside surface of the trash bag presenting an exposed adhesive surface for trapping insects that enter the bag, the at least one adhesive patch including silhouette decoys of insects in a contrasting color to attract insects.

2. In combination with a trash container having a trash-receiving volume and an opening surrounded by a rim, a trash bag lining the trash-receiving volume, the trash bag having an inside surface, an outside surface, and an opening, and at least one adhesive patch on the inside surface of the trash bag inside the container presenting an exposed adhesive surface for trapping insects that enter the bag, the at least one adhesive patch including silhouette decoys of insects in a contrasting color to attract insects that enter the bag.

3. A trash bag of the type including a sidewall forming a trash-receiving volume, and having an inside surface, an outside surface, and an opening, the improvement comprising at least two elongate adhesive patches on the inside surface of the trash bag which together extend substantially continuously around the inside of the bag, spaced sufficiently from the opening that when the bag is installed in a conventional trash container the adhesive patches are inside the container presenting an exposed adhesive surface for trapping insects that enter the bag.

4. In combination with a trash container having a trash-receiving volume and an opening surrounded by a rim, a trash bag lining the trash-receiving volume, the trash bag having an inside surface, an outside surface, and an opening, and at least two elongate adhesive patches on the inside surface of the trash bag inside the container which together extend substantially continuously around the inside of the bag, spaced sufficiently from the opening that when the bag is installed in the trash container, the adhesive patches are inside the trash container, presenting an exposed adhesive surface for trapping insects that enter the bag.

5. A plastic trash bag having a sidewall having an inside surface and an outside surface, the sidewall having an opening therein and defining a trash receiving volume, at least two exposed adhesive patches on the inside surface of the sidewall, the patches extending substantially continuously around the inside surface of the bag, spaced sufficiently from the opening that when the bag is installed in a conventional trash container, the adhesive patches are inside the container.

* * * * *